US009410763B2

(12) United States Patent
Colt

(10) Patent No.: US 9,410,763 B2
(45) Date of Patent: Aug. 9, 2016

(54) ANGLE-ADJUSTABLE BUFFER TUBE SYSTEM

(71) Applicant: Robert Eric Colt, Bolivar, PA (US)

(72) Inventor: Robert Eric Colt, Bolivar, PA (US)

(73) Assignee: Robert Eric Colt, Bolivar, PA (US)

( * ) Notice: Subject to any disclaimer, the term of this patent is extended or adjusted under 35 U.S.C. 154(b) by 0 days.

(21) Appl. No.: 14/830,090

(22) Filed: Aug. 19, 2015

(65) Prior Publication Data

US 2016/0054094 A1 Feb. 25, 2016

Related U.S. Application Data

(60) Provisional application No. 62/039,243, filed on Aug. 19, 2014.

(51) Int. Cl.
*F41C 23/04* (2006.01)
*F41C 23/14* (2006.01)

(52) U.S. Cl.
CPC ..... *F41C 23/04* (2013.01); *F41C 23/14* (2013.01)

(58) Field of Classification Search
CPC ..... F41C 23/04; F41C 23/14
USPC ..... 42/75.03, 71.01, 73
See application file for complete search history.

(56) References Cited

U.S. PATENT DOCUMENTS 2,491,492 A * 12/1949 Gaidos ..... F41A 3/82 42/75.01
8,806,791 B2 * 8/2014 Cottle ..... F41A 19/11 42/71.01
8,950,099 B2 * 2/2015 Rogers ..... F41C 23/04 42/71.01
8,955,245 B2 * 2/2015 Chvala ..... F41C 23/14 42/1.06
9,228,795 B1 * 1/2016 Kielsmeier ..... F41C 23/14
9,261,324 B1 * 2/2016 Liang ..... F41C 23/04
2010/0064566 A1 * 3/2010 Kerbrat ..... F41A 1/08 42/1.06
2010/0077643 A1 * 4/2010 Kerbrat ..... F41A 3/06 42/1.06
2012/0137562 A1 * 6/2012 Langevin ..... F41C 23/04 42/75.03
2013/0097911 A1 * 4/2013 Larue ..... F41C 23/04 42/73
2015/0267979 A1 * 9/2015 Miller ..... F41A 3/00 89/191.01
2016/0047612 A1 * 2/2016 Sullivan ..... F16J 9/16 89/191.01

* cited by examiner

*Primary Examiner* — Michael David

(57) ABSTRACT

An angle-adjustable buffer tube system is a system that enables fluid transitions between a primary scope or sight and a backup offset iron sight without requiring the shooter to remove his or her cheek from the stock. The system includes a buffer tube and a firearm-mounting tube that is able to rotate concentric to the buffer tube. A stock may be mounted to the buffer tube while the firearm-mounting tube may be screwed into the body of a firearm. A lockable flange assembly featuring a flange, a mounting plate, a flange socket, and a plurality of grooves enables the rotation and additionally is able to lock the buffer tube and the firearm-mounting tube in place after the firearm has been rotated to a desired position. An annular retention plate is utilized to ensure that the buffer tube and the firearm-mounting tube do not separate from each other.

17 Claims, 20 Drawing Sheets

SECTION A-A

SECTION B-B

SECTION C-C

ANGLE-ADJUSTABLE BUFFER TUBE SYSTEM

The current application claims a priority to the U.S. Provisional Patent application Ser. No. number 62/039,243 filed on Aug. 19, 2014.

FIELD OF THE INVENTION

The present invention relates generally to a buffer tube system for mounting a stock to a firearm. More specifically, the present invention is an angle-adjustable buffer tube system that allows the firearm to be rotated during use of an offset iron sight without the shooter losing cheek weld with the stock.

BACKGROUND OF THE INVENTION

When engaging targets at long range, it is most common for a shooter to utilize a scope or similar sight that has been properly calibrated to accommodate for the multiple ballistic factors that may affect the flight trajectory of a projectile after being discharged. However, in the event that the shooter is required to engage targets at a closer range, a long range scope or sight may prove disadvantageous due to the magnification provided by the scope or sight. Because of the possible need for a shooter to rapidly engage targets at both close range and long range, it is common to mount an offset iron sight to the firearm as well. The offset iron sight is utilized as a close range backup sight to the primary scope or similar sight that is utilized for long range shooting.

While an offset iron sight functions in the exact same manner as a conventional iron sight, the shooter is disadvantaged due to the fact that the firearm that he or she is holding must be moved and held in an unfamiliar manner. An offset iron sight is typically offset at a 45° angle from the horizontal plane in order to avoid impeding the use of a primary scope or sight when the offset iron sight is mounted to a firearm. This can create an awkward and uncomfortable shooting experience for the shooter due to the fact that the entire firearm must be tilted, shifting the stock from a stable position on the shooter's shoulder. As a result, the shooter is much less likely to be successful when shooting the firearm from this position.

The present invention is an angle-adjustable buffer tube system that allows a shooter to rotate a firearm when utilizing an offset iron sight without shifting or otherwise manipulating the stock from a stable position against the shooter's shoulder. This allows the shooter to maintain cheek weld with the stock and keep his or her eyes on a target when transitioning from a primary scope or sight to the offset iron sight and vice versa.

DETAIL DESCRIPTIONS OF THE INVENTION

All illustrations of the drawings are for the purpose of describing selected versions of the present invention and are not intended to limit the scope of the present invention.

The present invention is an angle-adjustable buffer tube system for allowing fluid transitions between a primary scope or sight and a backup offset iron sight. The present invention is shown in FIGS. 1-6 and comprises a buffer tube 1, a firearm-mounting tube 3, and a lockable flange assembly 6.

The buffer tube 1 is an elongated tube onto which a stock may be mounted. The firearm-mounting tube 3 is the component that is screwed into the body of the firearm. For example, in the preferred embodiment of the present invention, the firearm-mounting tube 3 is screwed into the lower receiver of an AR-15 style rifle. The firearm-mounting tube 3 is able to rotate with respect to the buffer tube 1. The lockable flange assembly 6 allows for the rotation between the buffer tube 1 and the firearm-mounting tube 3. Additionally, the lockable flange assembly 6 is able to securely hold the buffer tube 1 in place once the firearm-mounting tube 3 has been rotated to a desired position.

Figure 1:
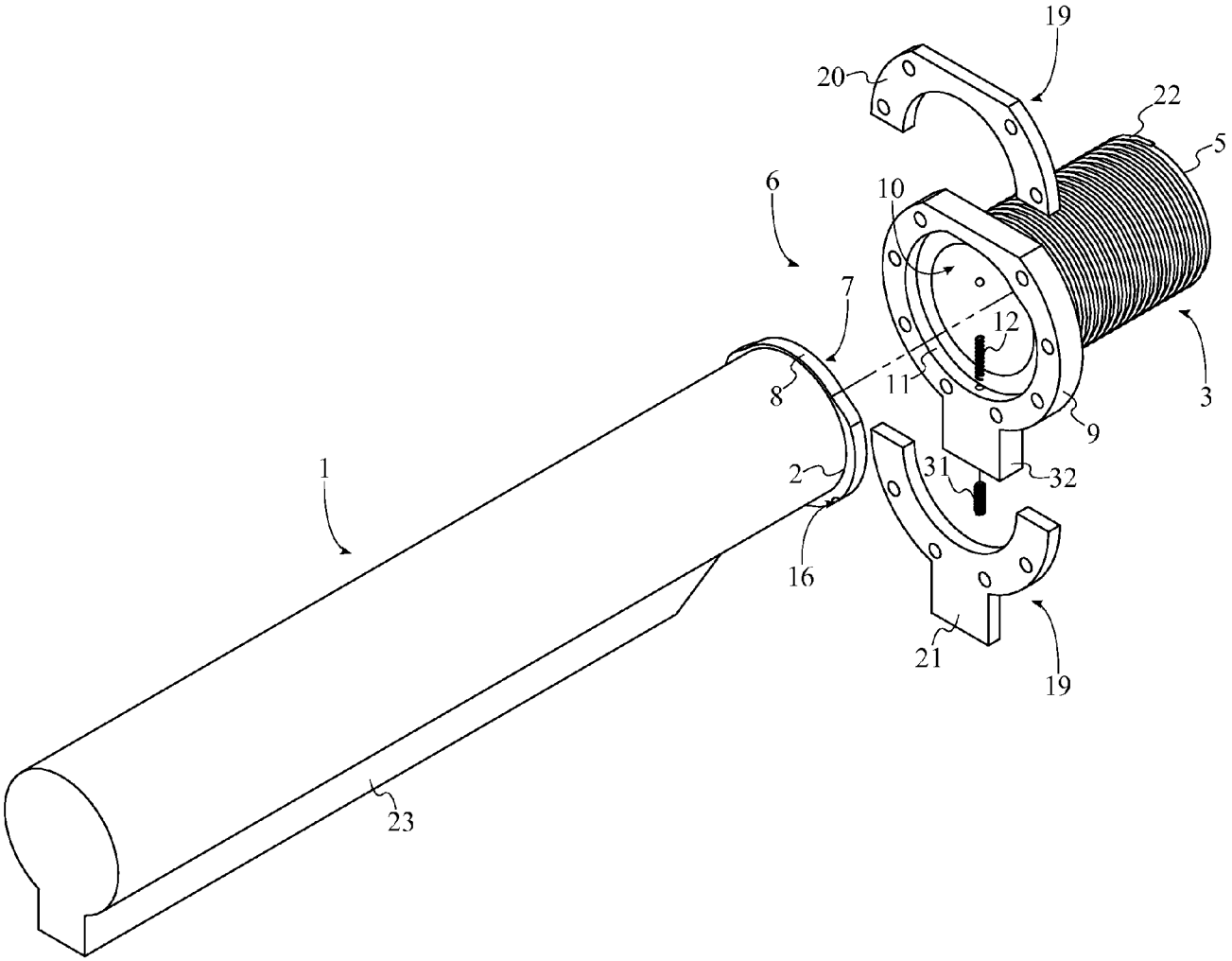
FIG. 1 is a top exploded perspective view of the present invention.
Figure 2:
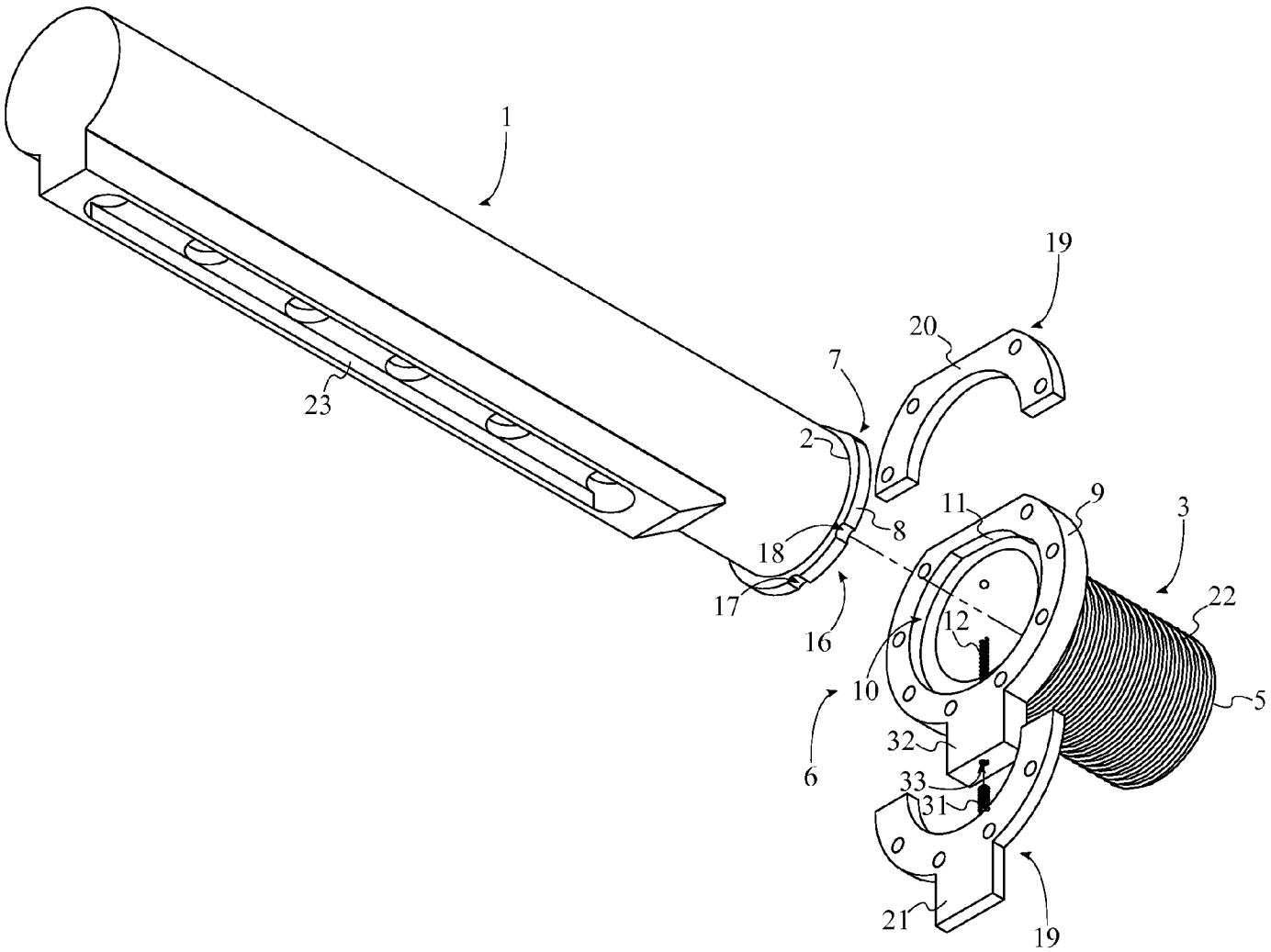
FIG. 2 is a bottom exploded perspective view of the present invention.
Figure 3:
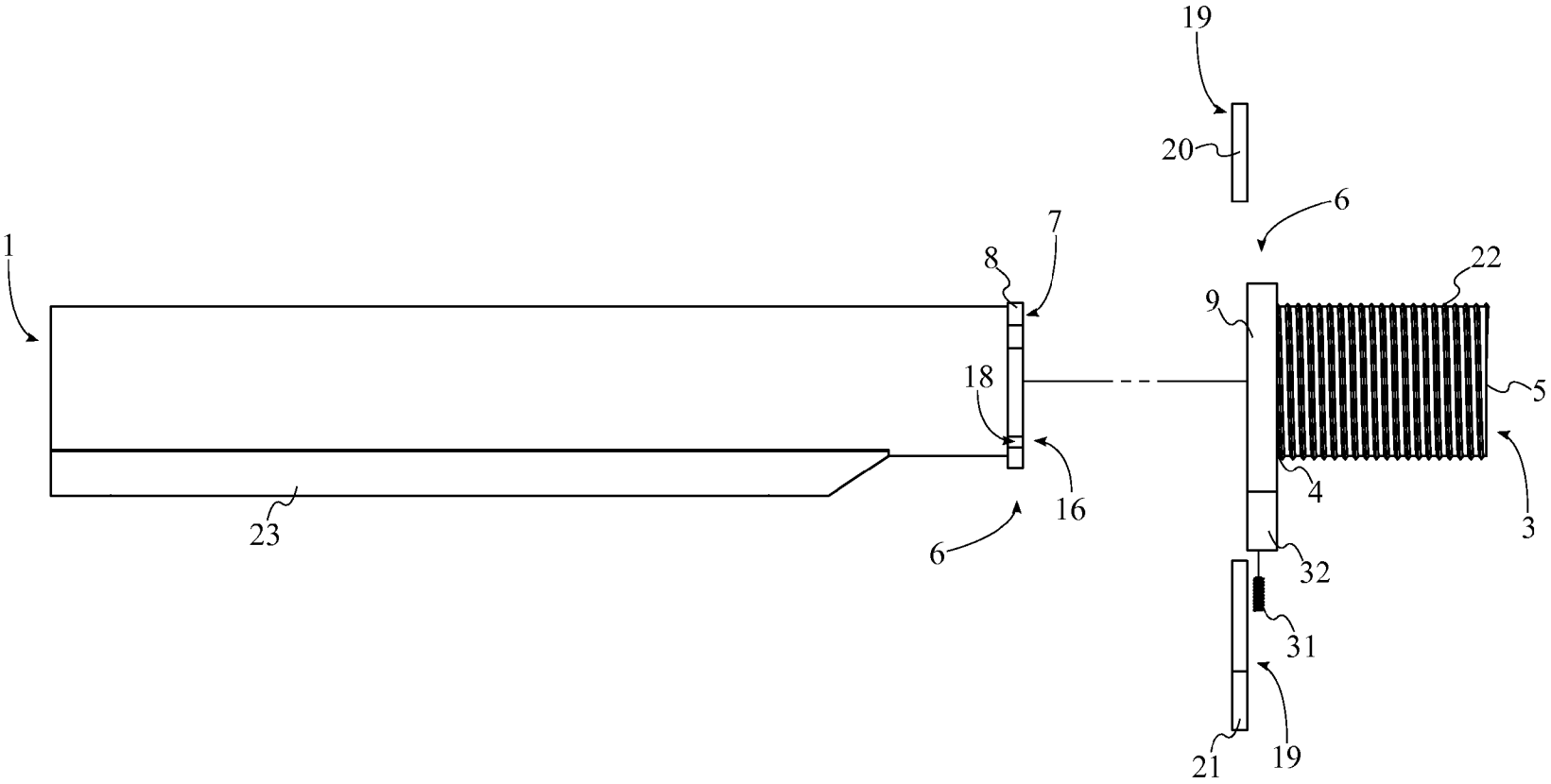
FIG. 3 is an exploded side view of the present invention.
Figure 4:
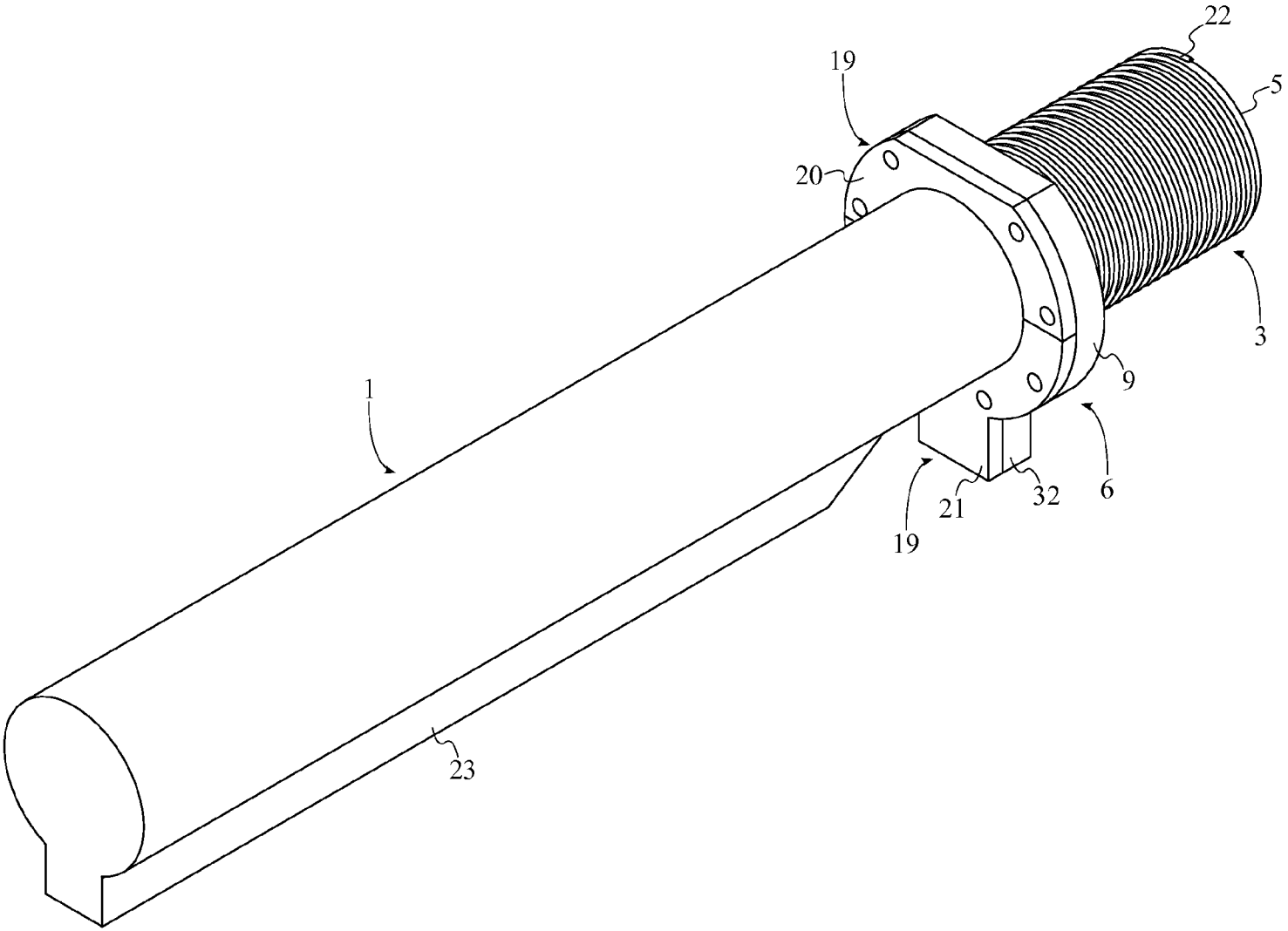
FIG. 4 is a top perspective view of the present invention in the neutral configuration.
Figure 5:
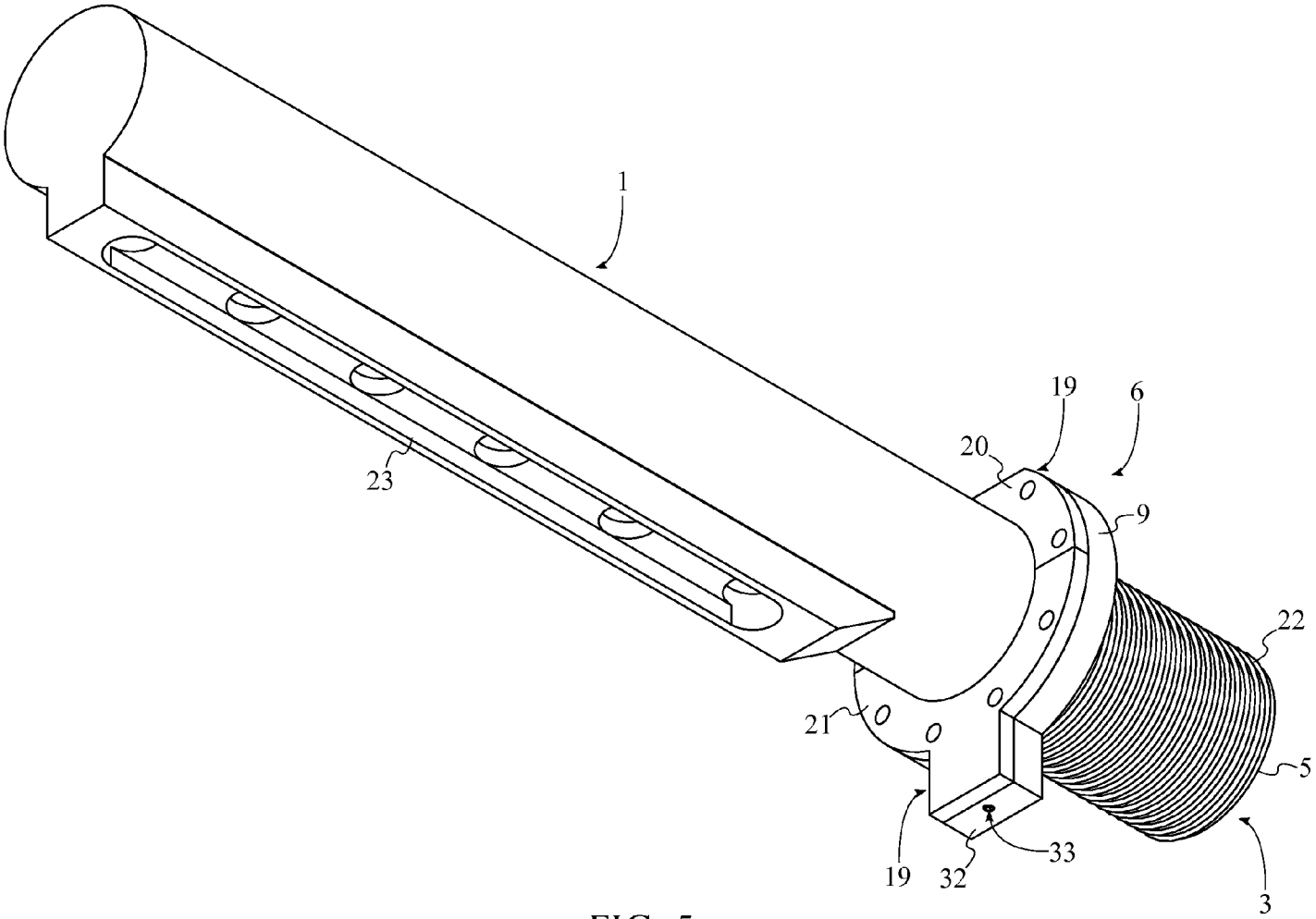
FIG. 5 is a bottom perspective view of the present invention in the neutral configuration.
Figure 6:
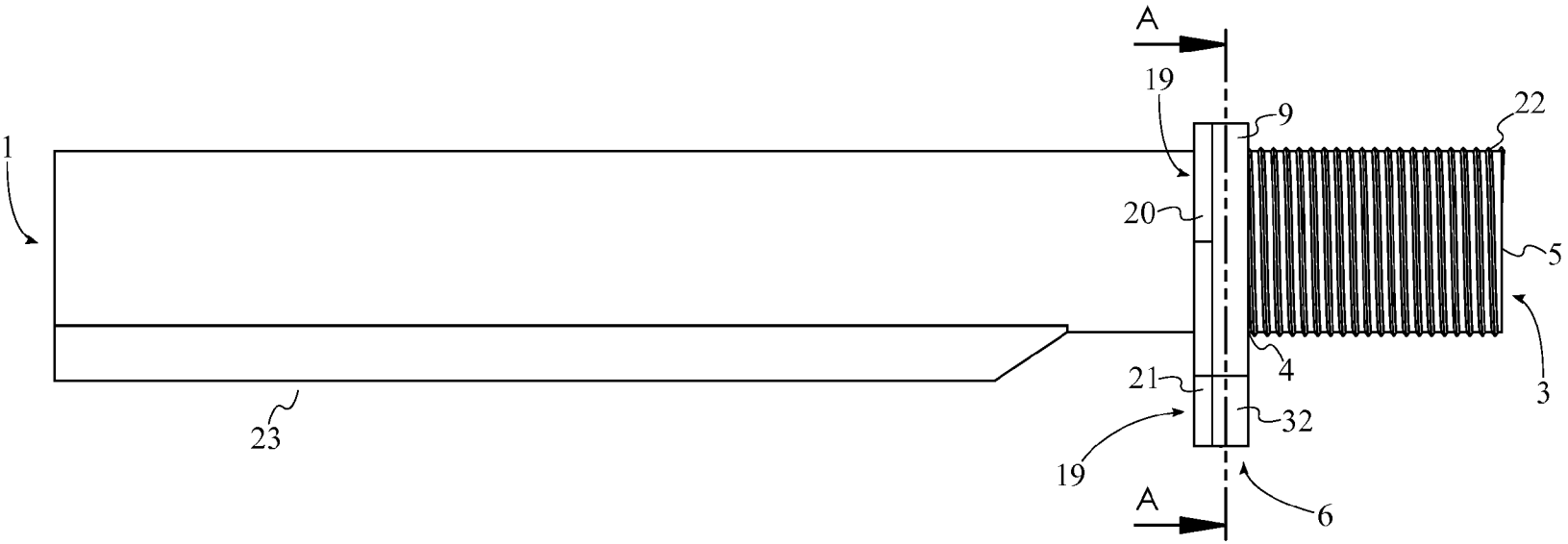
FIG. 6 is a side view of the present invention in the neutral configuration.
Figure 7:
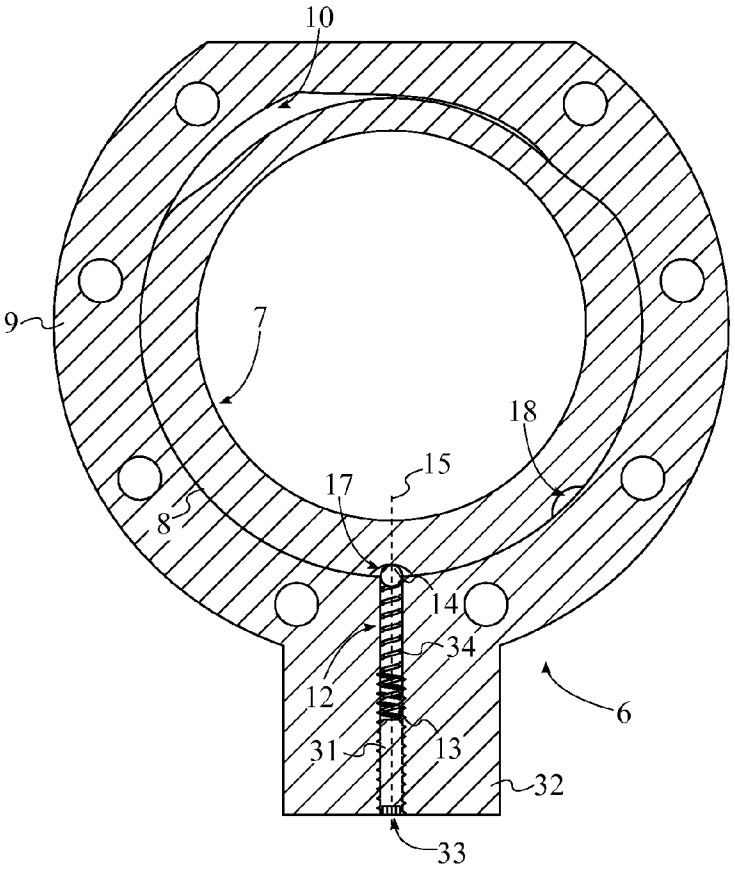
FIG. 7 is a cross-sectional view of the present invention in the neutral configuration taken along line A-A of FIG. 6.
Figure 8:
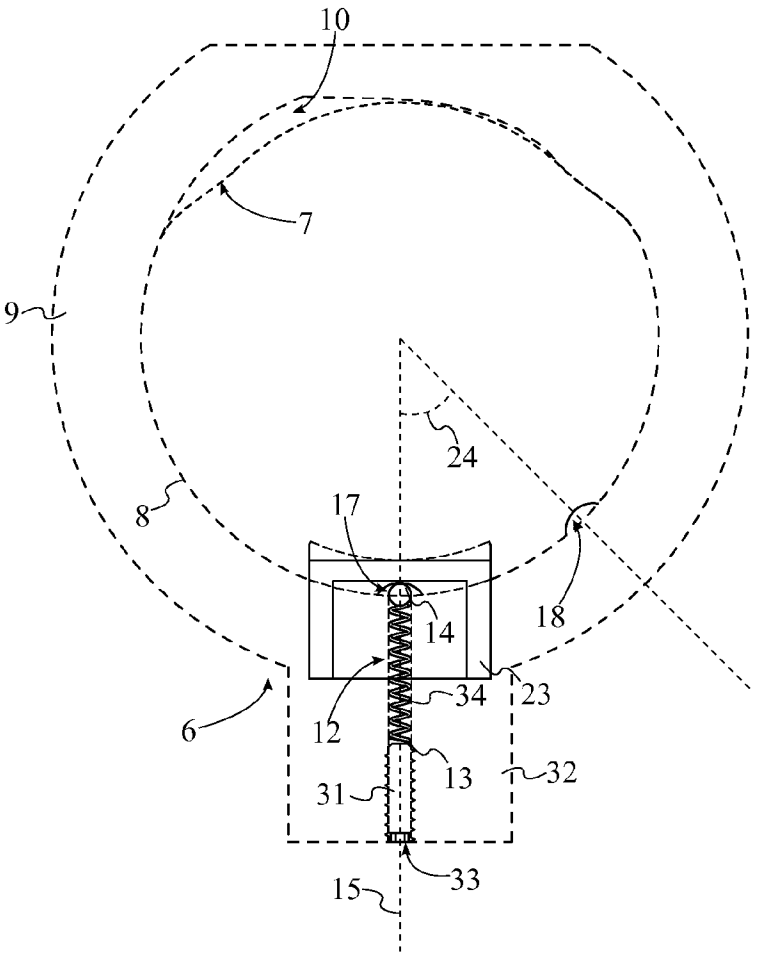
FIG. 8 is a rear internal view of the present invention in the neutral configuration.
Figure 9:
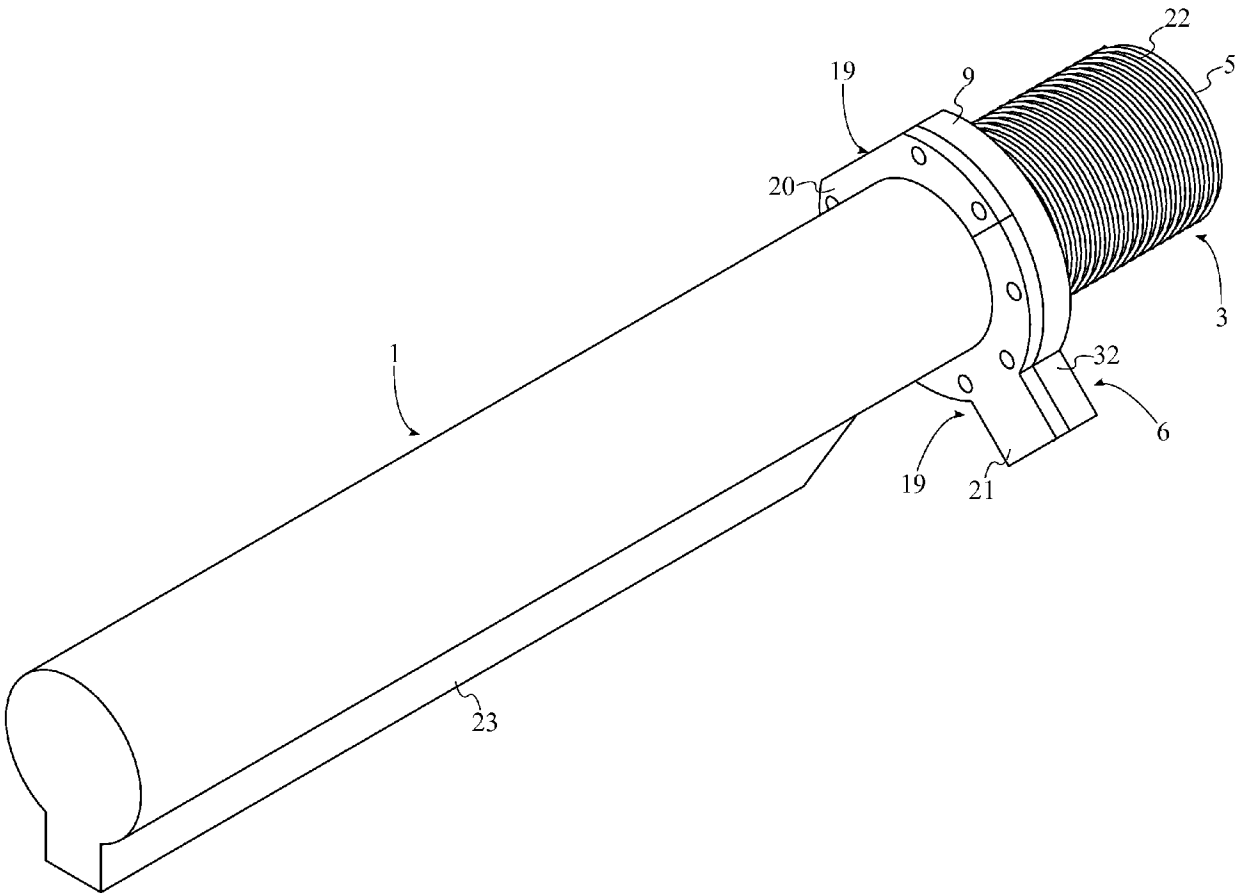
FIG. 9 is a top perspective view of the present invention in the right-handed tilted configuration.
Figure 10:
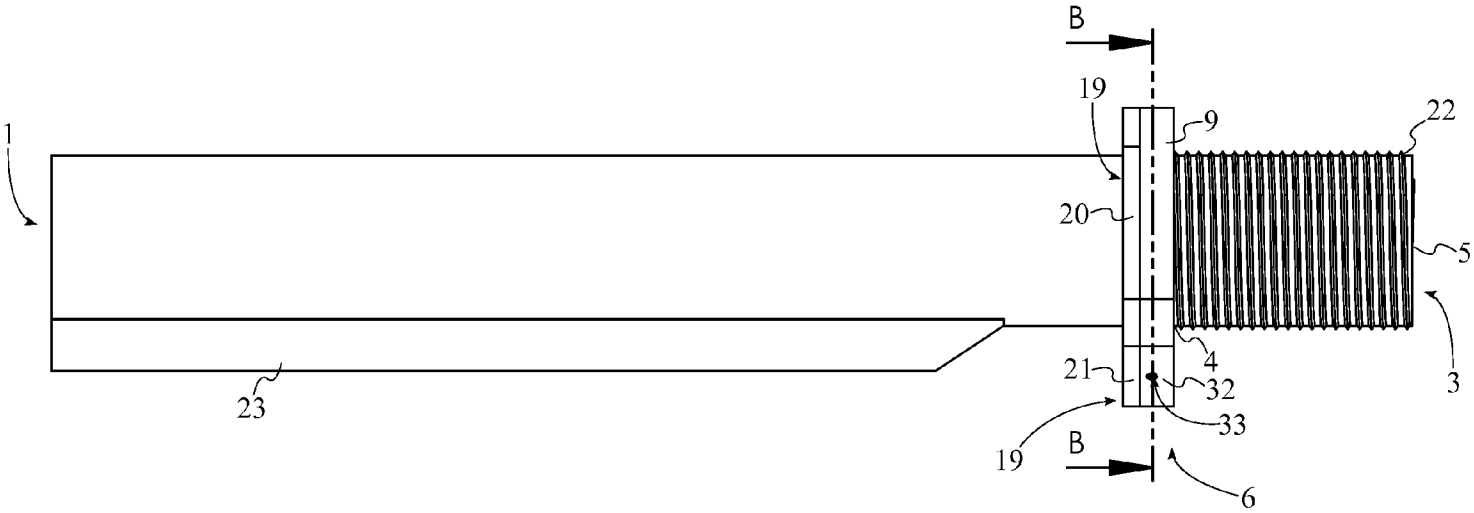
FIG. 10 is a side view of the present invention in the right-handed tilted configuration.
Figure 11:
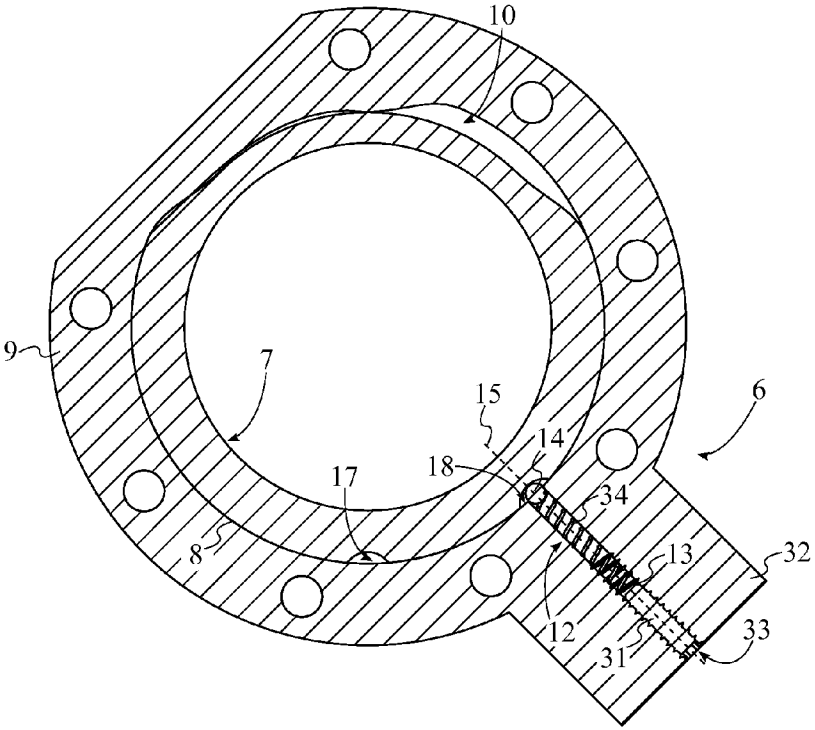
FIG. 11 is a cross-sectional view of the present invention in the right-handed tilted configuration taken along line B-B of FIG. 10.
Figure 12:
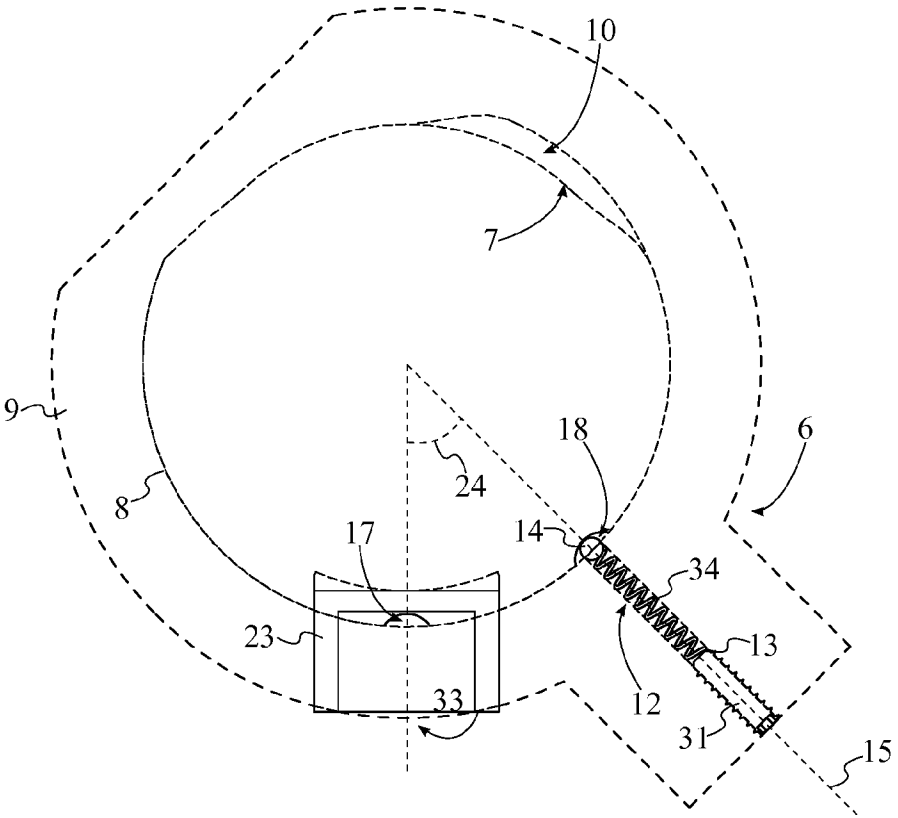
FIG. 12 is a rear internal view of the present invention in the right-handed tilted configuration.
Figure 13:
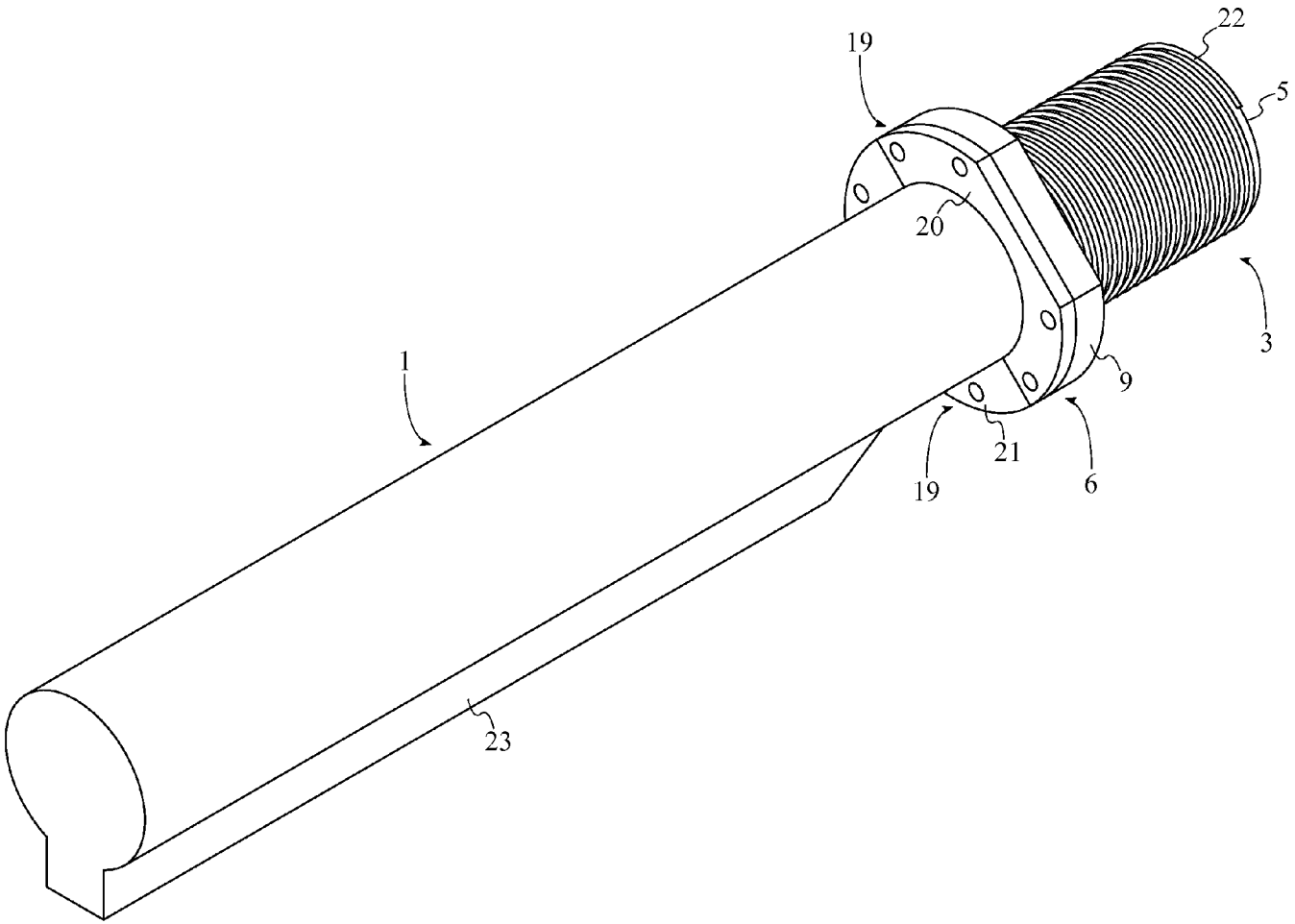
FIG. 13 is a top perspective view of the present invention in the left-handed tilted configuration.
Figure 14:
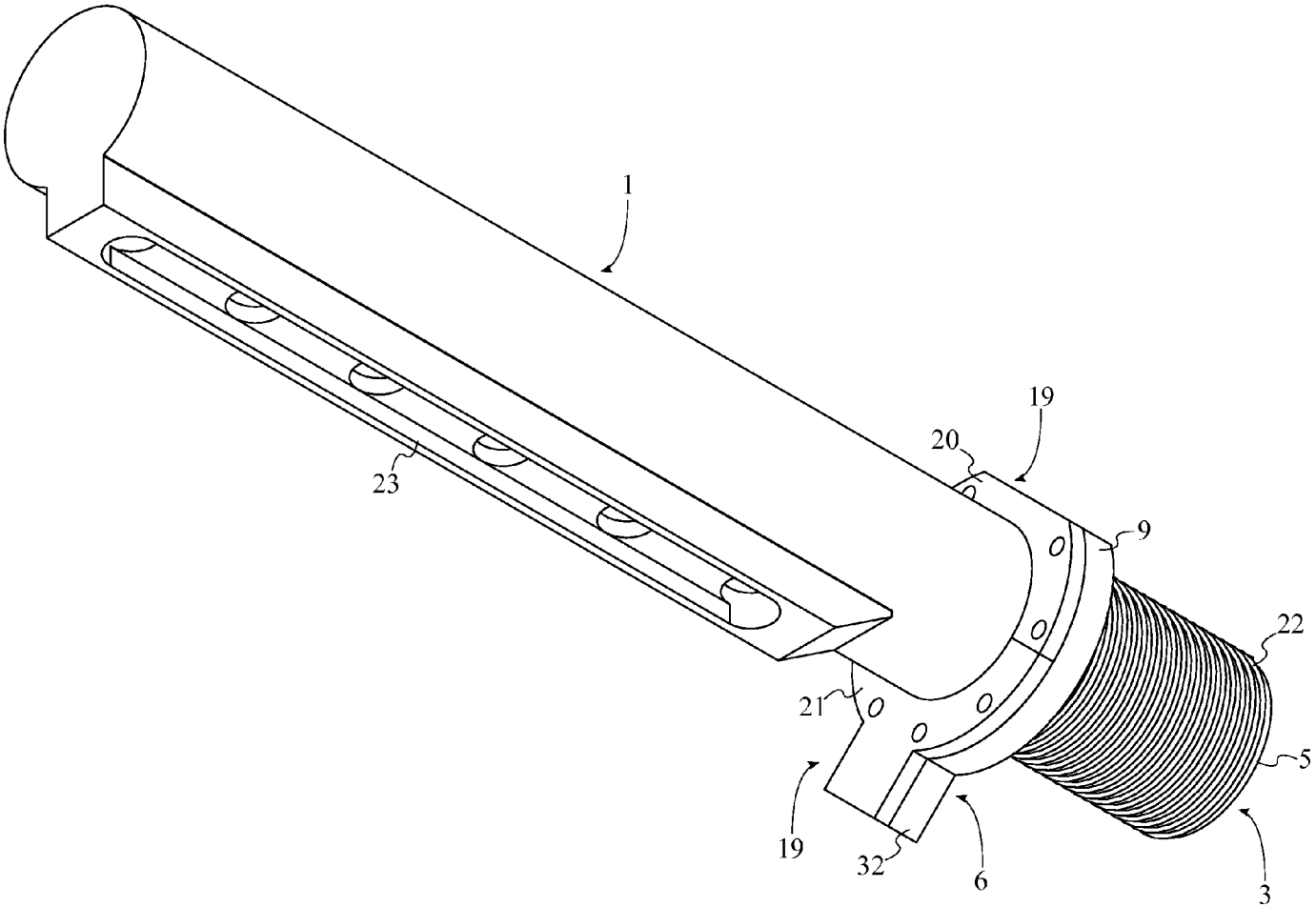
FIG. 14 is a bottom perspective view of the present invention in the left-handed tilted configuration.
Figure 15:
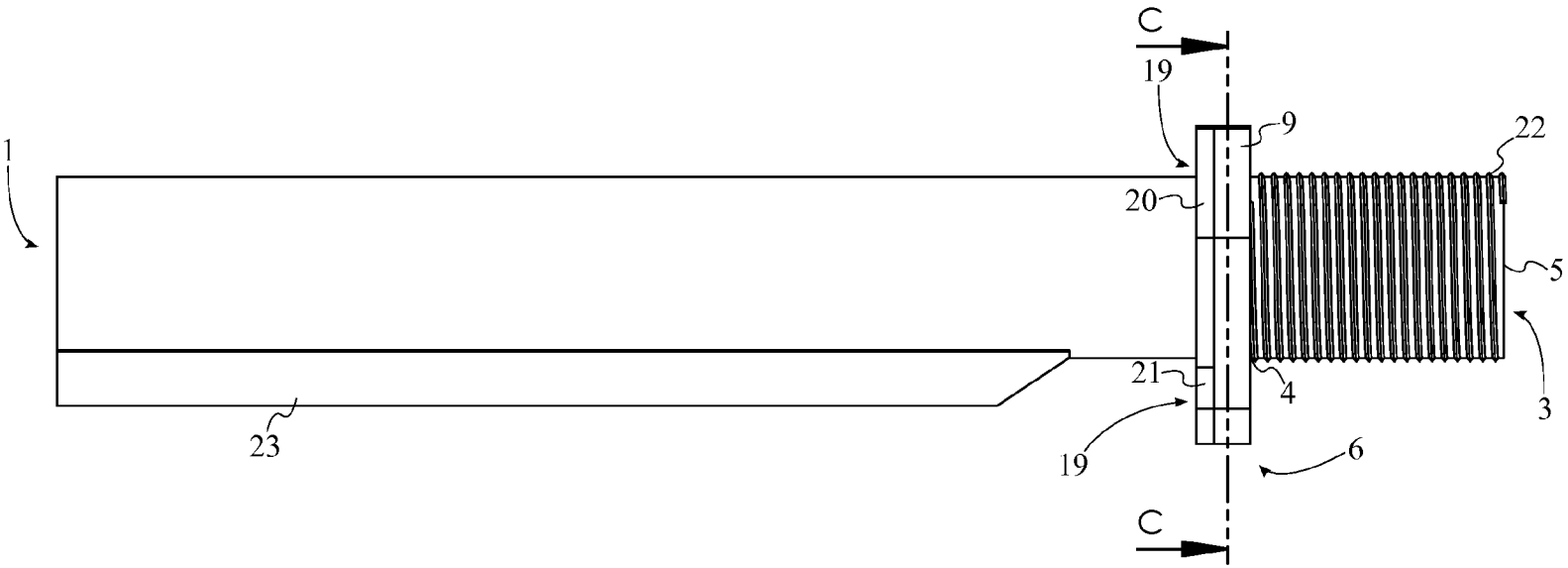
FIG. 15 is a side view of the present invention in the left-handed tilted configuration.
Figure 16:
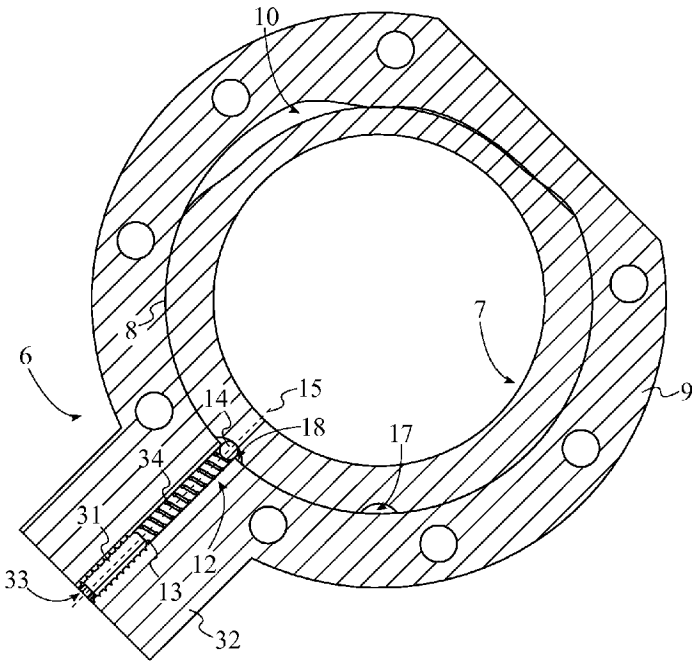
FIG. 16 is a cross-sectional view of the present invention in the left-handed tilted configuration taken along line C-C of FIG. 15.
Figure 17:
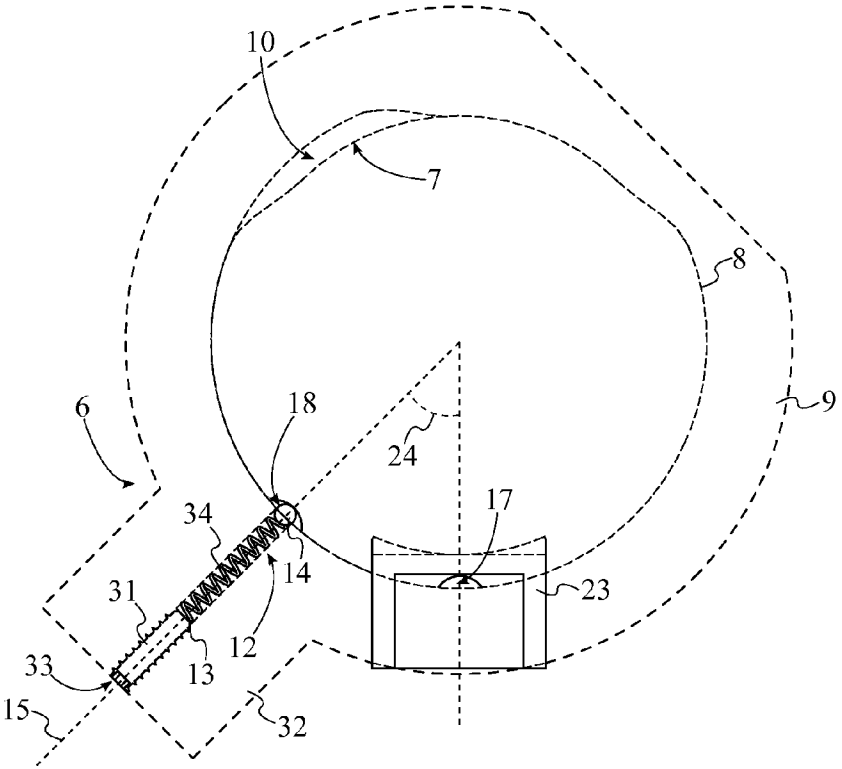
FIG. 17 is a rear internal view of the present invention in the left-handed tilted configuration.

With reference to FIG. 7 and FIG. 8, the lockable flange assembly 6 comprises a flange 7, a mounting plate 9, a flange socket 10, a spring-loaded ball plunger 12, and a plurality of grooves 16. The flange 7 is concentrically connected about a first end 2 of the buffer tube 1, enabling the flange 7 to rotate with the buffer tube 1. Similarly, the mounting plate 9 is concentrically and adjacently connected to a first end 4 of the firearm-mounting tube 3, allowing the mounting plate 9 to rotate with the firearm-mounting tube 3. The flange socket 10 traverses into the mounting plate 9 in order to accommodate the flange 7 within the flange socket 10. The flange 7 is rotatably mounted into the flange socket 10, enabling the firearm-mounting tube 3 to rotate with respect to the buffer tube 1. Additionally, the flange 7 remains concentric to the flange socket 10, ensuring that the buffer tube 1 and the firearm-mounting tube 3 remain concentrically aligned during rotation. By extension, the firearm to which the firearm-mounting tube 3 is mounted is able to rotate, allowing the shooter to tilt the firearm in a manner that facilitates the use of an offset iron sight.

The spring-loaded ball plunger 12 and the plurality of grooves 16 are utilized to lock the flange 7 in place within the flange socket 10 after the firearm-mounting tube 3 has been rotated to the desired position. The plurality of grooves 16 traverses into an outer lateral surface 8 of the flange 7, allowing the plurality of grooves 16 to accommodate the spring-loaded ball plunger 12 when locking the flange 7 in place within the flange socket 10. The plurality of grooves 16 is radially offset from each other about the outer lateral surface 8 of the flange 7. This enables the firearm-mounting tube 3 to be rotated to one of multiple positions before being locked into place. A fixed end 13 of the spring-loaded ball plunger 12 is mounted into an inner lateral surface 11 of the flange socket 10, ensuring that the spring-loaded ball plunger 12 is securely positioned within the inner lateral surface 11. An engagement end 14 of the spring-loaded ball plunger 12 is retractably seated into one of the plurality of grooves 16. This effectively locks the flange 7 in place when the spring-loaded ball plunger 12 is seated into the plurality of grooves 16. If the shooter wishes to again rotate the firearm-mounting tube 3, torsional force may be applied to the stock in order to overcome the lockable flange assembly 6 and dislodge the spring-loaded ball plunger 12 from the plurality of grooves 16.

Again with reference to FIGS. 1-6, the present invention further comprises an annular retention plate 19. The annular retention plate 19 is utilized to ensure that the buffer tube 1 and the firearm-mounting tube 3 do not become separated during use of the present invention. The annular retention plate 19 is laterally positioned around the buffer tube 1 to hold all portions of the flange 7 in place. The annular retention plate 19 is pressed against the flange 7 to securely hold the flange 7 in place within the flange socket 10. Additionally, the annular retention plate 19 is adjacently attached to the mounting plate 9. The annular retention plate 19 is thus able to cover both the flange 7 and the mounting plate 9 when holding the flange 7 in place within the flange socket 10. In the preferred embodiment of the present invention, the annular retention plate 19 comprises a first separable portion 20 and a second separable portion 21, which allow the annular retention plate 19 to be easily mounted to the buffer tube 1 by clamping the first separable portion 20 and the second separable portion 21 around the buffer tube 1. The first separable portion 20 and the second separable portion 21 are joined together in order to cover both the flange 7 and the mounting plate 9 to hold the flange 7 in place within the flange socket 10. The first separable portion 20 and the second separable portion 21 are positioned opposite to each other about the buffer tube 1. As such, when the first separable portion 20 and the second separable portion 21 are joined together, the first separable portion 20 and the second separable portion 21 are able to fully encircle the buffer tube 1. The first separable portion 20 and the second separable portion 21 may be secured to the mounting plate 9 via fasteners or a similar mechanism.

The present invention further comprises a male threading 22. The male threading 22 is helically connected around the firearm-mounting tube 3 from a second end 5 of the firearm-mounting tube 3 to the mounting plate 9. In the preferred embodiment of the present invention, the male threading 22 allows the firearm-mounting tube 3 to be screwed into the lower receiver of an AR-15 style rifle. The firearm-mounting tube 3 is screwed into the lower receiver of the AR-15 style rifle until the mounting plate 9 is positioned adjacent to the lower receiver.

The present invention further comprises a stock-mounting rail 23. The stock-mounting rail 23 allows a stock to be slidably mounted to the buffer tube 1. The stock-mounting rail 23 includes a plurality of stock-adjustment holes that allows the position of the stock to be adjusted to the shooter's comfort along the length of the buffer tube 1. The stock-mounting rail 23 is laterally mounted along the buffer tube 1. The shooter is able to extend or retract the stock as needed along the length of the buffer tube 1. A neutral groove 17 from the plurality of grooves 16 is radially aligned with the stock-mounting rail 23 from the buffer tube 1. The neutral groove 17 is the groove from the plurality of grooves 16 into which the spring-loaded ball plunger 12 is pressed when the firearm is held in a normal, non-tilted position. A tilting groove 18 from the plurality of grooves 16 is radially offset from the stock-mounting rail 23 about the buffer tube 1 by a tilting angle 24. The tilting groove 18 is the groove from the plurality of grooves 16 into which the spring-loaded ball plunger 12 is pressed when the firearm is tilted. As shown in FIGS. 9-12, in the preferred embodiment of the present invention, the tilting angle 24 is 45°, vertically orienting an attached offset iron sight when the firearm is tilted.

The flange 7, the spring-loaded ball plunger 12, and the plurality of grooves 16 are shown in a neutral configuration in FIGS. 4-8. In the neutral configuration, the firearm is held in a normal manner and is not tilted. The neutral configuration allows the shooter to utilize a scope or other primary sight that is attached to the firearm. The engagement end 14 of the spring-loaded ball plunger 12 is pressed against the neutral groove 17. The force provided by the spring-loaded ball plunger 12 on the neutral groove 17 prevents the flange 7 from rotating within the flange socket 10, effectively locking the buffer tube 1 and the firearm-mounting tube 3 in place due to the presence of the spring-loaded ball plunger 12 within the neutral groove 17. The neutral groove 17 is aligned with a central axis 15 of the spring-loaded ball plunger 12, allowing the spring-loaded ball plunger 12 to extend from the inner lateral surface 11 of the flange socket 10 into the space provided by the neutral groove 17.

The flange 7, the spring-loaded ball plunger 12, and the plurality of grooves 16 are shown in a tilted configuration in FIGS. 9-12. The tilted configuration is utilized when the shooter transitions from using a scope or other primary sight to an offset iron sight. Because the offset iron sight is oriented at an angle (most commonly 45°) from the vertical plane, the firearm is tilted in order to vertically orient the offset iron sight. In order to transition from the neutral configuration to the tilted configuration, the shooter is required to apply sufficient force to the lockable flange assembly 6 to overcome the lockable flange assembly 6 and dislodge the spring-loaded ball plunger 12 from the neutral groove 17. The firearm may then be tilted to the desired orientation, rotating the firearm-mounting tube 3. The buffer tube 1 remains fixed in place, keeping the stock firmly placed against the shooter's shoulder and allowing the shooter to maintain cheek weld with the stock during the tilting process. When the firearm is sufficiently tilted, the engagement end 14 of the spring-loaded ball plunger 12 is pressed into the tilting groove 18. The tilting groove 18 is offset from the stock-mounting rail 23 and the neutral groove 17 by the tilting angle 24, allowing the stock and the buffer tube 1 to remain unmoved while the firearm and the firearm-mounting tube 3 are tilted. The force provided by the spring-loaded ball plunger 12 on the tilting groove 18 prevents the flange 7 from rotating within the flange socket 10 after the firearm has been tilted. The buffer tube 1 and the firearm-mounting tube 3 are locked in place due to the presence of the spring-loaded ball plunger 12 within the tilting groove 18. The tilting groove 18 is aligned with a central axis 15 of the spring-loaded ball plunger 12 and as such, the spring-loaded ball plunger 12 is able to extend from the inner lateral surface 11 of the flange socket 10 and into the tilting groove 18. If the shooter wishes to return the flange 7, the spring-loaded ball plunger 12, and the plurality of grooves 16 to the neutral configuration, sufficient torsional force is applied to the stock to overcome the lockable flange assembly 6 and dislodge the spring-loaded ball plunger 12 from the tilting groove 18. The firearm is then rotated back to the normal position.

In the preferred embodiment of the present invention, the flange socket 10 is designed in a manner such that the firearm-mounting tube 3 is only able to rotate in one direction. The preferred embodiment of the present invention as shown in FIGS. 9-12 is designed for a right-handed shooter. An alternative left-handed embodiment of the present invention is shown in FIGS. 13-17. The left-handed embodiment includes a flange socket 10 and a plurality of grooves 16 that are designed to allow the firearm-mounting tube 3 to rotate in the opposite direction of that of the preferred embodiment.

Figure 18:
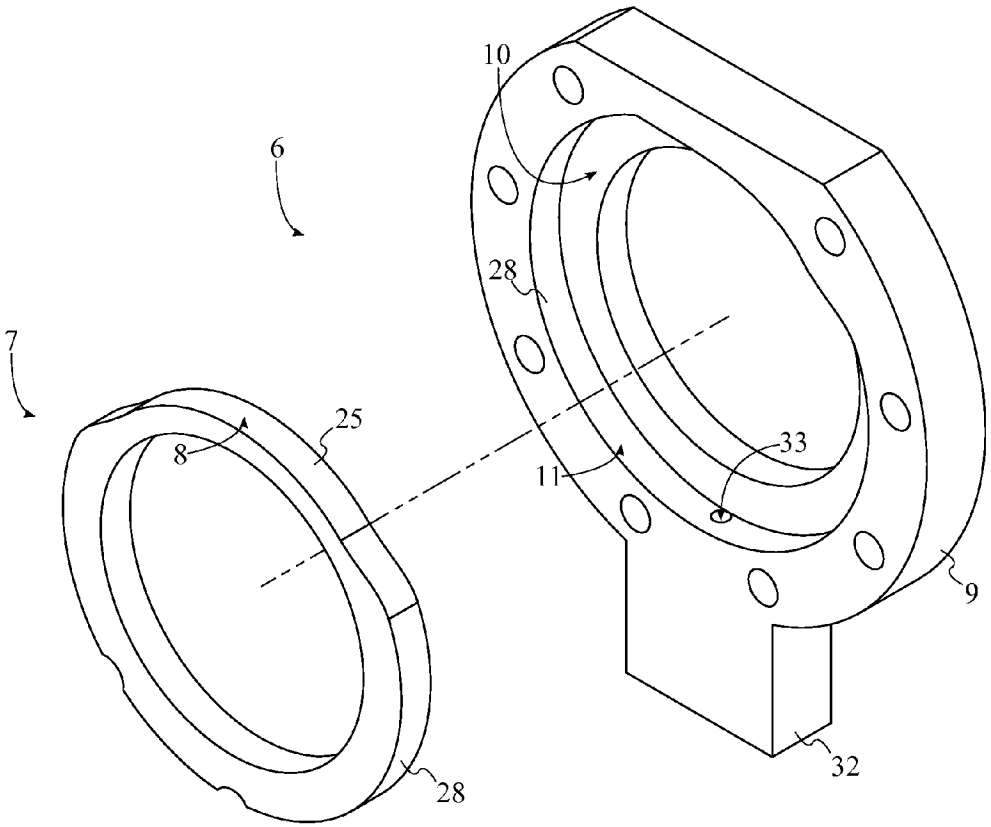
FIG. 18 is a top exploded perspective view of the buffer tube and the firearm-mounting tube.
Figure 19:
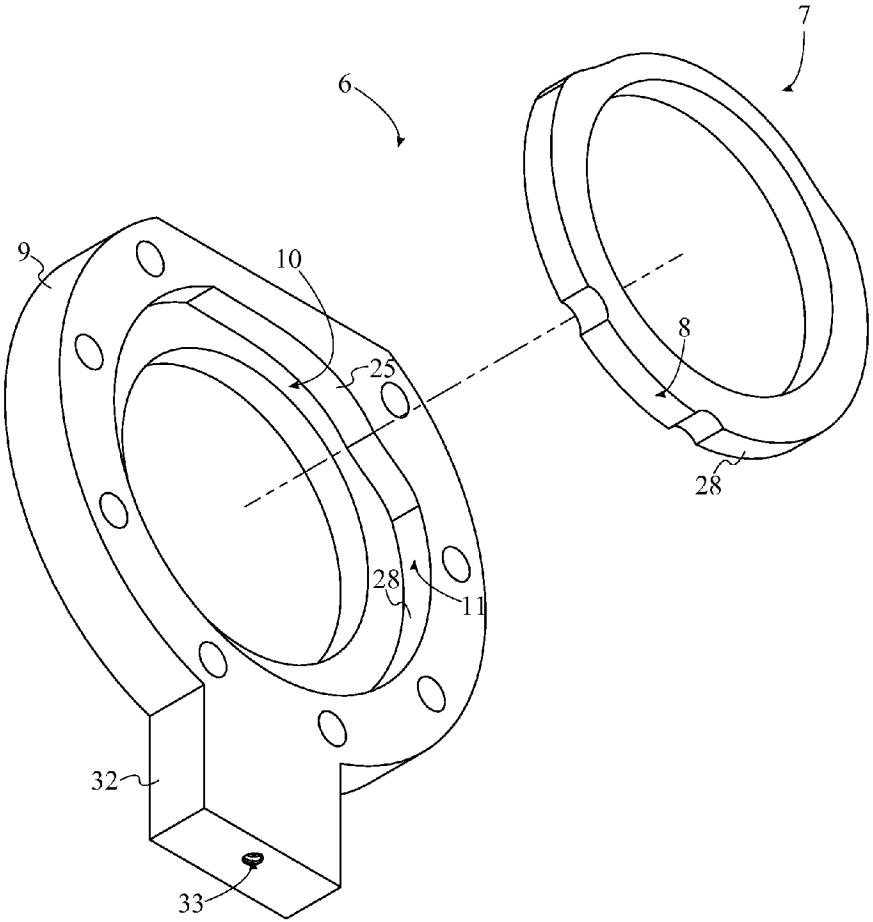
FIG. 19 is a bottom exploded perspective view of the buffer tube and the firearm-mounting tube.
Figure 20:
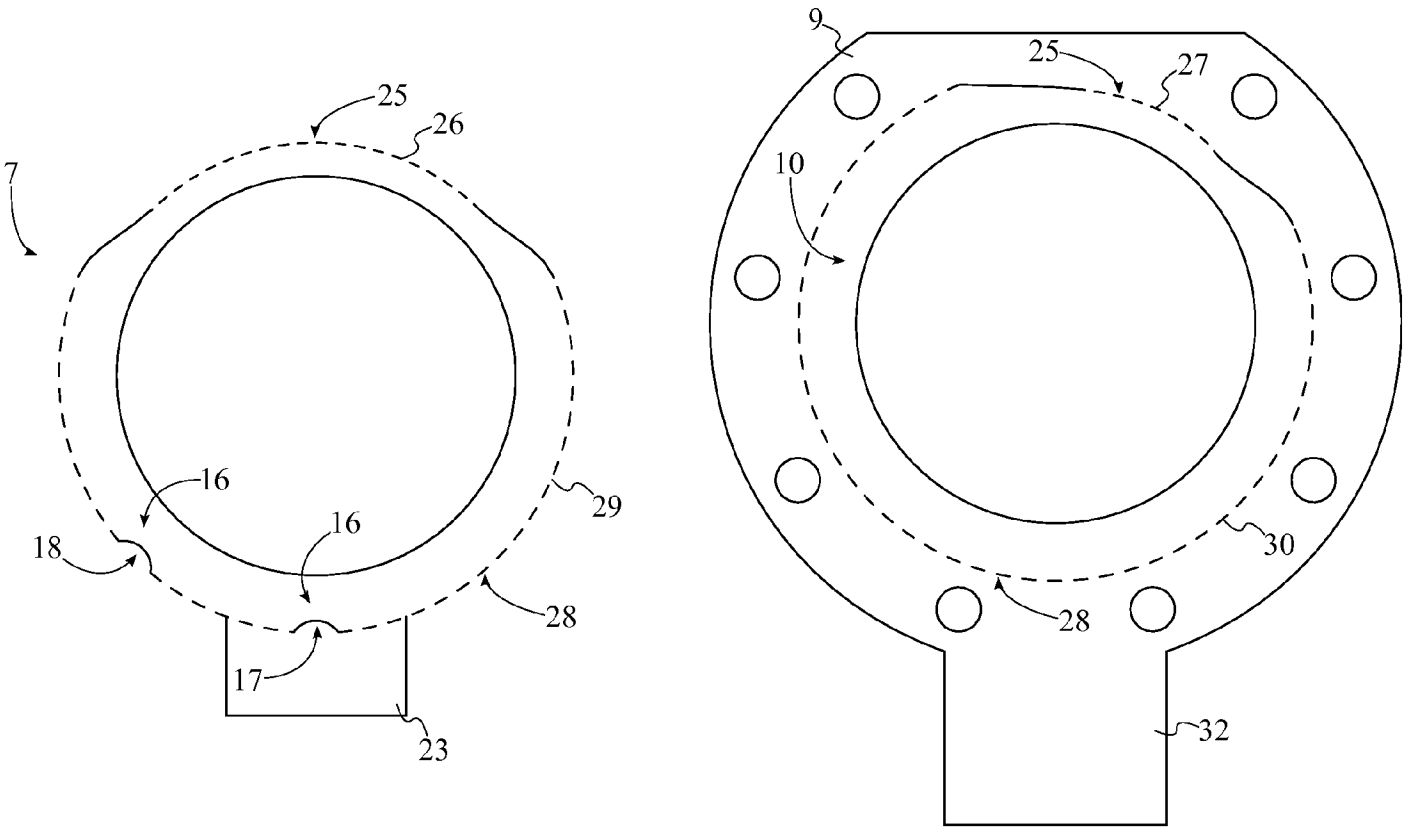
FIG. 20 is a front view of the buffer tube and the firearm-mounting tube.

As shown in FIGS. 18-20, the outer lateral surface 8 of the flange 7 and the inner lateral surface 11 of the flange socket 10 each comprise a first circular portion 25 and a second circular portion 28. The first circular portion 25 and the second circular portion 28 of the outer lateral surface 8 of the flange 7 and the first circular portion 25 and the second circular portion 28 of the inner lateral surface 11 of the flange socket 10 allow the firearm-mounting tube 3 to rotate with respect to the buffer tube 1. The first circular portion 25 of the flange 7 and the first circular portion 25 of the flange socket 10 are concentrically and coradially engaged to each other. Similarly, the second circular portion 28 of the flange 7 and the second circular portion 28 of the flange socket 10 are concentrically and coradially engaged to each other. This ensures that the flange 7 is able to snugly seat into the flange socket 10 while allowing the flange 7 to rotate within the flange socket 10. As shown in FIG. 20, the second circular portion 28 is radially greater than the first circular portion 25. This ensures that the rotation of the flange 7 within the flange socket 10 is stopped after the firearm-mounting tube 3 has been rotated to the desired position, preventing the firearm-mounting tube 3 from over-rotating. In the preferred embodiment of the present invention, an arc length 26 of the first circular portion 25 of the flange 7 is greater than an arc length 27 of the first circular portion 25 of the flange socket 10. As a result, an arc length 29 of the second circular portion 28 of the flange 7 is less than an arc length 30 of the second circular portion 28 of the flange socket 10. This configuration of geometric relations forms radially offset gaps between the first circular portion 25 and the second circular portion 28. As the flange 7 rotates within the flange socket 10, a first gap grows larger while a second gap grows smaller up to a limit, which prevents further rotation of the flange 7 within the flange socket 10. In the opposite rotational direction, the second gap grows smaller up to a limit, which prevents further rotation of the flange 7 within the flange socket 10.

As shown in FIG. 7, FIG. 8, FIG. 11, FIG. 12, FIG. 16, and FIG. 17, the user may adjust the tension of the spring-loaded ball plunger 12 through the use of a spring-adjustment screw 31. The present invention further comprises a housing tab 32 and a screw hole 33. The housing tab 32 is laterally connected to the mounting plate 9, allowing the spring-loaded ball plunger 12 to be positioned within the housing tab 32. The engagement end 14 of the spring-loaded ball plunger 12 is preferably a ball bearing while the fixed end 13 of the spring-loaded ball plunger 12 is preferably the first end of a spring 34. The spring 34 is thus able to press the ball bearing into the plurality of grooves 16. The screw hole 33 traverses through the housing tab 32, up to the inner lateral surface 11 of the flange socket 10. This allows the spring-adjustment screw 31 to come into contact with the spring 34 when the spring-adjustment screw 31 is positioned within the screw hole 33. The ball bearing is additionally positioned into the screw hole 33, adjacent to the inner lateral surface 11 of the flange socket 10. This positions the ball bearing within the plurality of grooves 16 to prevent rotation of the firearm-mounting tube 3. The spring-adjustment screw 31 is engaged into the screw hole and may be rotated to move the spring-adjustment screw 31 toward or away from the inner lateral surface 11 of the flange socket 10. The spring-adjustment screw 31 is pressed against the first end of the spring 34, opposite to the ball bearing. As such, when the spring-adjustment screw 31 is rotated inward toward the inner lateral surface 11 of the flange socket 10, the stiffness of the spring 34 is increased and the ball bearing is pressed harder against the plurality of grooves 16. Conversely, when the spring-adjustment screw 31 is rotated outward away from the inner lateral surface 11 of the flange socket 10, the stiffness of the spring 34 is decreased and the pressure exerted on the ball bearing is decreased.

Although the present invention has been explained in relation to its preferred embodiment, it is understood that many other possible modifications and variations can be made without departing from the spirit and scope of the present invention as hereinafter claimed.

What is claimed is:

1. An angle-adjustable buffer tube system comprises:
- a buffer tube;
- a firearm-mounting tube;
- a lockable flange assembly;
- the lockable flange assembly comprises a flange, a mounting plate, a flange socket, a spring-loaded ball plunger, and a plurality of grooves;
- the flange being concentrically connected about a first end of the buffer tube;
- the mounting plate being concentrically and adjacently connected to a first end of the firearm-mounting tube;
- the flange socket traversing into the mounting plate;
- the flange being rotatably mounted into the flange socket;
- the plurality of grooves traversing into an outer lateral surface of the flange;
- the plurality of grooves being radially offset from each other about the outer lateral surface of the flange;
- a fixed end of the spring-loaded ball plunger being mounted into an inner lateral surface of the flange socket; and
- an engagement end of the spring-loaded ball plunger being retractably seated into one of the plurality of grooves.

2. The angle-adjustable buffer tube system as claimed in claim 1 further comprises:
- an annular retention plate;
- the annular retention plate being laterally positioned around the buffer tube;
- the annular retention plate being pressed against the flange; and
- the annular retention plate being adjacently attached to the mounting plate.

3. The angle-adjustable buffer tube system as claimed in claim 2 further comprises:
- the annular retention plate comprises a first separable portion and a second separable portion; and
- the first separable portion and the second separable portion being positioned opposite to each other about the buffer tube.

4. The angle-adjustable buffer tube system as claimed in claim 1 further comprises:

a male threading; and the male threading being helically connected around the firearm-mounting tube from a second end of the firearm-mounting tube to the mounting plate.

5. The angle-adjustable buffer tube system as claimed in claim 1 further comprises:

a stock-mounting rail;

the stock-mounting rail being laterally mounted along the buffer tube;

a neutral groove from the plurality of grooves being radially aligned with the stock-mounting rail about the buffer tube; and a tilting groove from the plurality of grooves being radially offset from the stock-mounting rail about the buffer tube by a tilting angle.

6. The angle-adjustable buffer tube system as claimed in claim 5 further comprises:

wherein the flange, the spring-loaded ball plunger, and the plurality of grooves are in a neutral configuration;

the engagement end of the spring-loaded ball plunger being pressed into the neutral groove; and the neutral groove being aligned with a central axis of the spring-loaded ball plunger.

7. The angle-adjustable buffer tube system as claimed in claim 5 further comprises:

wherein the flange, the spring-loaded ball plunger, and the plurality of grooves are in a tilted configuration;

the engagement end of the spring-loaded ball plunger being pressed into the tilting groove; and the tilting groove being aligned with a central axis of the spring-loaded ball plunger.

8. The angle-adjustable buffer tube system as claimed in claim 1 further comprises:

the outer lateral surface of the flange and the inner lateral surface of the flange socket each comprise a first circular portion and a second circular portion;

the first circular portion of the flange and the first circular portion of the flange socket being concentrically and coradially engaged to each other;

the second circular portion of the flange and the second circular portion of the flange socket being concentrically and coradially engaged to each other;

the second circular portion being radially greater than the first circular portion;

an arc length of the first circular portion of the flange being greater than an arc length of the first circular portion of the flange socket; and an arc length of the second circular portion of the flange being less than an arc length of the second circular portion of the flange socket.

9. The angle-adjustable buffer tube system as claimed in claim 1 further comprises:

a spring-adjustment screw;

a housing tab;

a screw hole;

the engagement end of the spring-loaded ball plunger being a ball bearing;

the fixed end of the spring-loaded ball plunger being a first end of a spring;

the housing tab being laterally connected to the mounting plate;

the screw hole traversing through the housing tab, up to the inner lateral surface of the flange socket;

the spring being positioned into the screw hole;

the ball bearing being positioned into the screw hole, adjacent to the inner lateral surface of the flange socket;

the spring-adjustment screw being engaged into the screw hole; and the spring-adjustment screw being pressed against the first end of the spring, opposite to the ball bearing.

10. An angle-adjustable buffer tube system comprises:

a buffer tube;

a firearm-mounting tube;

a lockable flange assembly;

the lockable flange assembly comprises a flange, a mounting plate, a flange socket, a spring-loaded ball plunger, and a plurality of grooves;

the outer lateral surface of the flange and the inner lateral surface of the flange socket each comprise a first circular portion and a second circular portion;

the flange being concentrically connected about a first end of the buffer tube;

the mounting plate being concentrically and adjacently connected to a first end of the firearm-mounting tube;

the flange socket traversing into the mounting plate;

the flange being rotatably mounted into the flange socket;

the plurality of grooves traversing into an outer lateral surface of the flange;

the plurality of grooves being radially offset from each other about the outer lateral surface of the flange;

a fixed end of the spring-loaded ball plunger being mounted into an inner lateral surface of the flange socket;

an engagement end of the spring-loaded ball plunger being retractably seated into one of the plurality of grooves;

the first circular portion of the flange and the first circular portion of the flange socket being concentrically and coradially engaged to each other;

the second circular portion of the flange and the second circular portion of the flange socket being concentrically and coradially engaged to each other;

the second circular portion being radially greater than the first circular portion;

an arc length of the first circular portion of the flange being greater than an arc length of the first circular portion of the flange socket; and an arc length of the second circular portion of the flange being less than an arc length of the second circular portion of the flange socket.

11. The angle-adjustable buffer tube system as claimed in claim 10 further comprises:

an annular retention plate;

the annular retention plate being laterally positioned around the buffer tube;

the annular retention plate being pressed against the flange; and the annular retention plate being adjacently attached to the mounting plate.

12. The angle-adjustable buffer tube system as claimed in claim 11 further comprises:

the annular retention plate comprises a first separable portion and a second separable portion; and the first separable portion and the second separable portion being positioned opposite to each other about the buffer tube.

13. The angle-adjustable buffer tube system as claimed in claim 10 further comprises:

a male threading; and the male threading being helically connected around the firearm-mounting tube from a second end of the firearm-mounting tube to the mounting plate.

14. The angle-adjustable buffer tube system as claimed in claim 10 further comprises:

a stock-mounting rail;

the stock-mounting rail being laterally mounted along the buffer tube;

a neutral groove from the plurality of grooves being radially aligned with the stock-mounting rail about the buffer tube; and a tilting groove from the plurality of grooves being radially offset from the stock-mounting rail about the buffer tube by a tilting angle.

15. The angle-adjustable buffer tube system as claimed in claim 14 further comprises:

wherein the flange, the spring-loaded ball plunger, and the plurality of grooves are in a neutral configuration;

the engagement end of the spring-loaded ball plunger being pressed into the neutral groove; and the neutral groove being aligned with a central axis of the spring-loaded ball plunger.

16. The angle-adjustable buffer tube system as claimed in claim 14 further comprises:

wherein the flange, the spring-loaded ball plunger, and the plurality of grooves are in a tilted configuration;

the engagement end of the spring-loaded ball plunger being pressed into the tilting groove; and the tilting groove being aligned with a central axis of the spring-loaded ball plunger.

17. The angle-adjustable buffer tube system as claimed in claim 10 further comprises:

a spring-adjustment screw;

a housing tab;

a screw hole;

the engagement end of the spring-loaded ball plunger being a ball bearing;

the fixed end of the spring-loaded ball plunger being a first end of a spring;

the housing tab being laterally connected to the mounting plate;

the screw hole traversing through the housing tab, up to the inner lateral surface of the flange socket;

the spring being positioned into the screw hole;

the ball bearing being positioned into the screw hole, adjacent to the inner lateral surface of the flange socket;

the spring-adjustment screw being engaged into the screw hole; and the spring-adjustment screw being pressed against the first end of the spring, opposite to the ball bearing.

* * * * *